US005597203A

United States Patent [19]

Hubbard

[11] Patent Number: 5,597,203

[45] Date of Patent: Jan. 28, 1997

[54] SEAT WITH BIOMECHANICAL ARTICULATION

[75] Inventor: Robert P. Hubbard, East Lansing, Mich.

[73] Assignee: Board of Trustees Operating Michigan State University, East Lansing, Mich.

[21] Appl. No.: 259,662

[22] Filed: Jun. 14, 1994

[51] Int. Cl.[6] ..... A47C 3/025

[52] U.S. Cl. ..... 297/284.3; 297/284.1; 297/284.11; 297/301.1

[58] Field of Search ..... 297/284.3, 284.1, 297/299, 306, 284.11, 312

[56] References Cited

U.S. PATENT DOCUMENTS

| | | | |
|---|---|---|---|
| 3,121,592 | 2/1962 | Anderson | 297/284.1 |
| 3,833,257 | 9/1974 | Dove . | |
| 3,877,750 | 4/1975 | Scholpp . | |
| 3,989,297 | 11/1976 | Kerstholt | 297/306 X |
| 4,017,118 | 4/1977 | Cawley . | |
| 4,126,355 | 11/1978 | Rosenheck . | |
| 4,275,714 | 6/1981 | Lewis . | |
| 4,505,513 | 3/1985 | Barley . | |
| 4,585,272 | 4/1986 | Ballarini . | |
| 4,832,401 | 5/1989 | Brooks . | |
| 4,944,554 | 7/1990 | Gross et al. . | |
| 4,966,413 | 10/1990 | Palarski . | |
| 5,062,676 | 11/1991 | Mars | 297/284.3 X |
| 5,288,130 | 2/1994 | Foster | 297/306 X |

FOREIGN PATENT DOCUMENTS

| | | | |
|---|---|---|---|
| 800488 | 12/1950 | Germany | 297/284.11 |
| 36732 | 3/1983 | Japan | 297/284.11 |

*Primary Examiner*—Laurie K. Cranmer
*Attorney, Agent, or Firm*—Bliss McGlynn, P.C.

[57] ABSTRACT

A seat with biomechanical articulation for a person seated in the seat includes a seat portion extending generally horizontally, a back portion extending generally upwardly from the seat portion, a frame interconnecting the seat portion and the back portion, the seat portion having a seat member pivotally connected to the frame, and a structure for supporting a pelvis of a person seated on the seat member and moving in response to movement of the seat member by the person seated in the seat. The frame may be replaced by the frame of an existing seat such as a wheelchair frame.

19 Claims, 2 Drawing Sheets

FIG 1
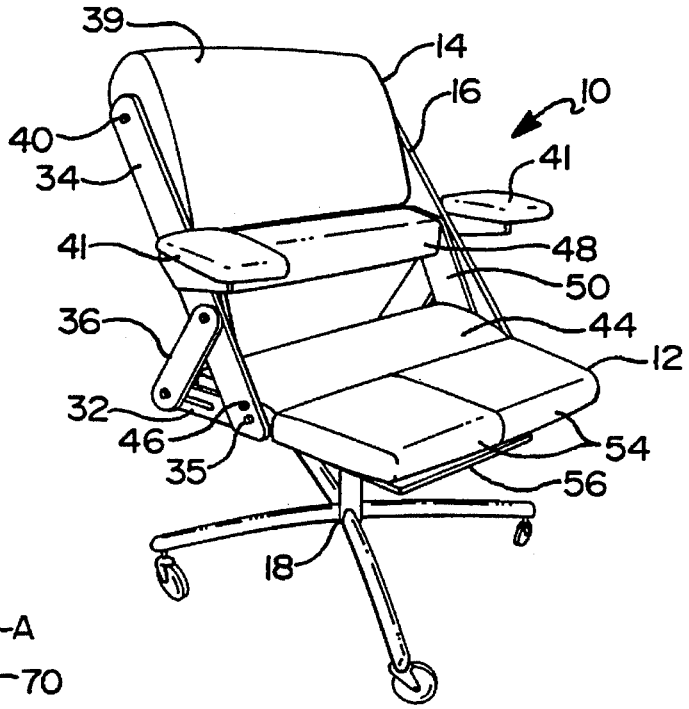
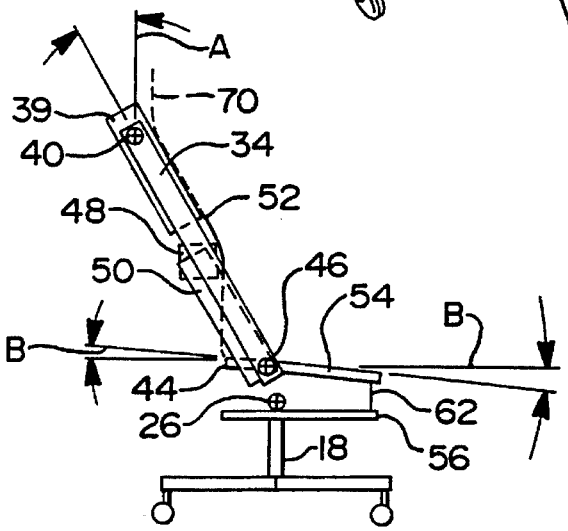
FIG 3
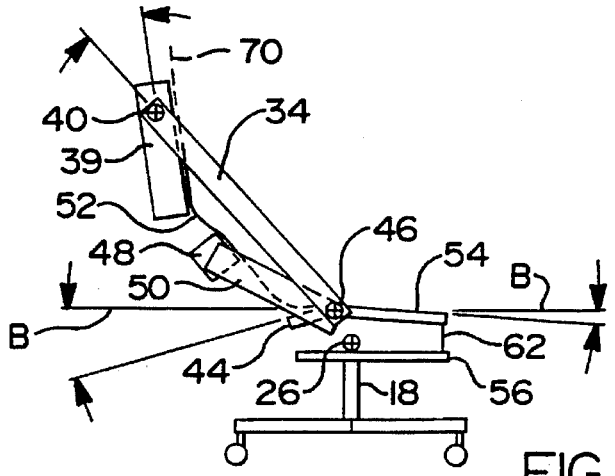
FIG 4

SEAT WITH BIOMECHANICAL ARTICULATION

BACKGROUND OF THE INVENTION

1. Field of the Invention

The present invention relates generally to seats for people in all types of seating applications, such as in markets for the home, office, and medicine (such as wheelchairs) and private, industrial, and military vehicles and aircraft. The present invention relates more particularly to a seat with biomechanical articulation for a person seated in the seat.

2. Description of the Related Art

Today, seats for people typically have a seat portion and a back portion which may be adjustable relative to each other. Generally, the seat portion and back portion are rigid. These seats do not provide geometric compatibility and movement capability between a person's body and the seat that accommodate changes of spinal curvature, torso recline angle and leg position. Geometrical compatibility between the person's body and seat and an ability to move are essential for comfort. If there is geometric interference between the body and seat in any position that a person may choose, then that person will not be comfortable.

One attempt to provide a seat with geometric compatibility is by incorporating a floating lumbar. An example of a seat with a floating lumbar is disclosed in U.S. Patent No. 4,832,401 to Brooks. This patented seat has a seat back joined to a seat cushion frame via a floor and two generally parallel spaced apart frame members. The patented seat also has a lumbar support resiliently, slidably and pivotally connected to the frame members. When a person sits in the patented seat, a femur seating surface deflects downward which causes the lumbar support to be pulled downward against the action of a spring to assure a fit to the spine of the seated person.

One disadvantage of the above patented seat is that it lacks sufficient articulation to move with and support a person's body. Another disadvantage of the patented seat is that it is not geometrically compatible with the person's body shape as the person's body is positioned in different postures.

SUMMARY OF THE INVENTION

It is, therefore, one object of the present invention to provide a seat with biomechanical articulation for a person seated in the seat.

It is another object of the present invention to provide a seat with biomechanical articulation that fits a person's body shape and moves with and supports the person's body in the seat.

It is yet another object of the present invention to provide a seat with biomechanical articulation that is geometrically compatible with the person's body shape as the person's body is positioned in different postures and as the person's body moves from one posture to another in the seat.

To achieve the foregoing objects, the present invention is a seat with biomechanical articulation for a person seated in the seat including a seat portion extending generally horizontally, a back portion extending generally upwardly from the seat portion, a frame interconnecting the seat portion and the back portion, the seat portion having a seat member pivotally connected to the frame and means for supporting a pelvis of a person seated on the seat member and moving in response to movement of the seat member by the person seated in the seat.

One advantage of the present invention is that a seat with biomechanical articulation is provided for a person seated in the seat. Another advantage of the present invention is that the seat has biomechanical articulation to provide geometric compatibility between the seated person's body and the seat. Yet another advantage of the present invention is that the seat has biomechanical articulation to maintain this compatibility between the body and seat for different positions and movements from position to position, such as changes of spinal curvature, torso recline angle and leg position. Still another advantage of the present invention is that the seat has biomechanical articulation to eliminate interference with body contours for desirable pressure distributions which do not concentrate pressures where the seat tends to protrude into the person's body. A further advantage of the present invention is that the seat has biomechanical articulation to support the body in postures which are desirable either from the person's personal preference or based on knowledge of seating, such as seating with lumbar curvature to rotate the top of pelvis and bottom rib cage forward and the top of the rib cage rearward which improve breathing and reduces lumbar spinal disc pressures. A still further advantage of the present invention is that the seat has biomechanical articulation to provide the ability to move from one seating position to another when the first position becomes uncomfortable or for the performance of a task so that the seated person does not become forced by the seat to remain in the same position.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 1 is a perspective view of a seat with biomechanical articulation according to the present invention.

FIG. 3 is an elevational schematic view of the seat of FIGS. 1 and 2 illustrated in a first operational position.

FIG. 4 is a view similar to FIG. 3 illustrating the seat of FIGS. 1 and 2 in a second operational position.

DESCRIPTION OF THE PREFERRED EMBODIMENT(S)

Figure 2:
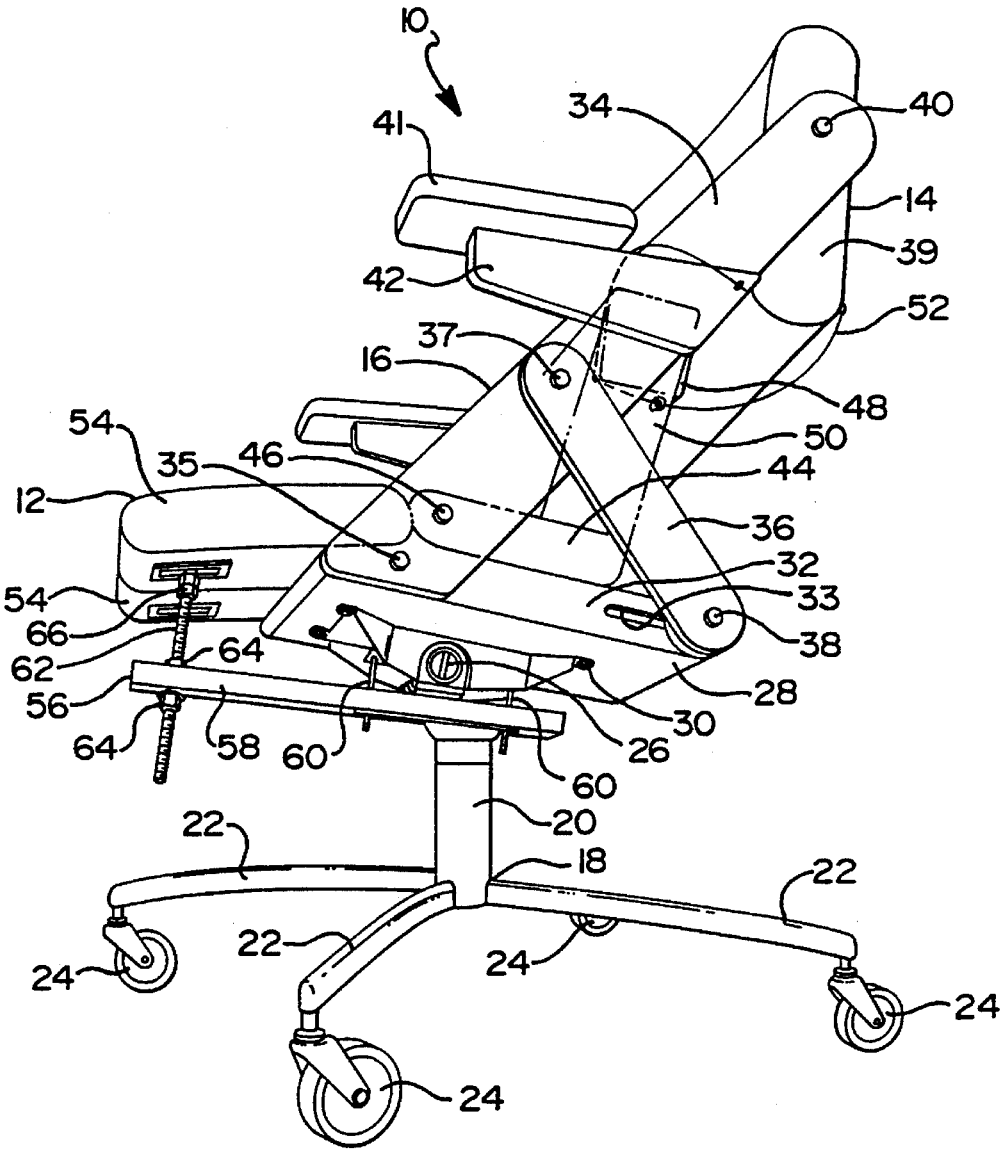
FIG. 2 is a perspective view of the seat with biomechanical articulation of FIG. 1.

Referring to the drawings, a seat 10, according to the present invention, is shown for seating people. The seat 10 shown in the drawings represents one form of the present invention as used in the office seating industry. It should be appreciated that the seat 10 may be in various forms depending on the industry in which used.

Referring to FIGS. 1 and 2, a seat 10 with biomechanical articulation, according to the present invention, is shown for a person (not shown) to be seated in the seat 10. The seat 10 includes a generally horizontally orientated seat portion 12, a generally upright orientated back portion 14 and a frame 16 interconnecting the seat portion 12 and back portion 14. The seat 10 may include a base 18 for supporting the seat portion 12 in spaced relationship upon a support surface such as a floor. It should be appreciated that the base 18 is optional depending on the form in which the seat 10 is used.

The base 18 has a center post 20 and a plurality of legs 22 extending outwardly from the center post 20. The legs 22 may include rollers or wheels 24 pivotally connected thereto for allowing the base 18 to move or roll along the support surface. The base 18 also has a rocker mechanism 26 connected to an upper end of the center post 20 to allow the seat portion 12 to rock or pivot relative to the base 18. The rocker mechanism 26 may also be connected to the center post 20 to allow rotation about and relative to the center post 20. It should be appreciated that the base 18 is conventional and known in the art.

The frame 16 includes a bottom member 28 connected to the rocker mechanism 26 by suitable means such as fasteners 30. The bottom member 28 is generally planar and rectangular in shape. The frame 16 also includes a pair of laterally spaced base members 32 connected to the lateral sides of the bottom member 28 by suitable means such as brackets and fasteners (not shown). The base members 32 have a generally rectangular shape and an elongated slot 33 near one end for a function to be described. The frame 16 includes a pair of laterally spaced side members 34 having one end pivotally connected to a forward end of the base members 32 by suitable means such as fasteners 35. The side members 34 are generally rectangular shaped and extend up and rearward to define a recline angle to be described. The frame 16 further includes a pair of laterally spaced recline members 36 having one end pivotally connected to the side members 34 by suitable means such as fasteners 37. The recline members 36 are generally rectangular shaped and extend down and rearward. The ends of the recline members 36 are pivotally connected to the base members 32 by suitable means such as fasteners 38 which extend through the slot 33 in the base members 32. The fasteners 38 may be adjustably moved along the slot 33 to define the recline angle for the side members 34 relative to the bottom member 28. It should be appreciated that the base members 32 and bottom member 28 may be integral and formed as one-piece. It should also be appreciated that the frame 16 may be from an existing seat, for example, a wheelchair frame.

The back portion 14 has a rib cage or torso support 39 to support the rib cage or torso of the seated person. The torso support 39 is generally rectangular in shape and may have a forward portion contoured to contact the seated person. The torso support 39 is disposed and extends laterally between the side members 34. The torso support 39 is pivotally secured to an upper portion of the side members 34 by suitable means such as fasteners 40. It should be appreciated that the torso support 39 pivots or rotates about a torso pivot axis defined by the fasteners 40 relative to the frame 16. It should also be appreciated that the orientation of the torso support 39 in FIG. 2 is for illustrative purposes only.

The seat 10 may include arm rests 41 to support the arms of the seated person. The arm rests 41 are generally rectangular in shape. The arm rests 41 are disposed along each lateral side and secured by suitable means such as brackets 42 and fasteners (not shown) to the side members 34. It should be appreciated that the arm rests 41 are fixed relative to the side members 34.

The seat portion 12 has a seat member 44 extending laterally and disposed between the side members 34. The seat member 44 is generally rectangular in shape and has a forward end pivotally connected to a lower portion of the side members 34 by suitable means such as fasteners 46. It should be appreciated that the seat member 44 pivots or rotates about a pelvis pivot axis defined by the fasteners 46 relative to the frame 16.

The seat 10 also includes a pelvis support 48 to support the pelvis of the seated person. The pelvis support 48 is generally rectangular in shape. The pelvis support 48 is disposed below the torso support 39 and extends laterally between the side members 34. The seat 10 includes support members 50 interconnecting the pelvis support 48 and the seat member 44. The support members 50 are generally rectangular in shape and fixedly secured to the pelvis support 48 and seat member 44 by suitable means such as fasteners (not shown). It should be appreciated that the pelvis support 48 pivots or rotates about the pelvis pivot axis defined by the fasteners 46 relative to the frame 16.

The seat 10 may include a compliant support 52 interconnecting the torso support 39 and pelvis support 48. The compliant support 52 urges or pulls the pelvis support 48 upward toward the torso support 39 as illustrated in FIG. 3. The compliant support 52 may be of a type such as shock or elastic cords that have one end connected to the torso support 39 and extend under the pelvis support 48 and around the arm rest bracket 42. The other end of the compliant support 52 may be secured to either the arm rest bracket 42 or side members 34. The compliant support 52 supports the pelvis support 48 to resist the weight of the person as the pelvis support 48 rotates downward about the pelvis pivot axis defined by the fasteners 46. The compliant support 52 couples the motion of the pelvis support 48 and torso support 39 so that they rotate together and follow the person's body motion. The compliant support 52 follows the motion of the pelvis support 48 and torso support 39 to follow the motion of the person's body and support their lower back. It should be appreciated that a mechanism (not shown) could be provided that determines the relative positions of the pelvis support 48 and the torso support 39 to follow the motions of the torso or to impose motions on the torso.

The seat 10 also includes at least one, preferably a pair of thigh supports 54 pivotally attached to the seat member 44 by suitable means such as hinges (not shown). The thigh supports 54 pivot or rotate relative to the seat member 44 to provide individual movement when the person's legs are in positions such as while operating a machine that requires different movements of the person's legs. It should be appreciated that the thigh supports 54 do not lift into the back of the person's thighs as the seat 10 reclines by the rocker mechanism 26.

The seat 10 further includes a stop portion 56 which supports the thigh supports 54 and limits the downward movement of the thigh supports 54. The stop portion 56 includes a support member 58 secured to a stationary portion of the rocker mechanism 26 by suitable means such as fasteners 60. The support member 58 is fixed relative to the base 18 and does not recline. The stop portion 56 also includes adjustable stop members 62 extending upwardly from the support member 58 at a forward end thereof. The stop members 62 are threaded fasteners which extend through the support member 58 and secured thereto by nuts 64. The stop members 62 have a head portion 66 to engage and support the thigh supports 54 and limit downward movement thereof.

Referring to FIGS. 3 and 4, the operation and movement of the seat 10 will now be described. The seat 10 fits and moves the occupant like a biomechanical model. Such a biomechanical model is disclosed in "New Biomechanical Models for Automobile Seat Design" by Hubbard et al., SAE paper No. 930110, which is hereby incorporated by reference.

In FIG. 3, the seat 10 is illustrated schematically and has a first operational position in which a back contour 70 of a person in a lumbar extension is shown in dotted lines. The torso support 39 is generally at an angle to a vertical axis A relative to the fasteners 40 and the pelvis support 48 is rotated upwardly at the back about the pelvis pivot axis defined by the fasteners 46 and urged toward the torso support 39 by the compliant support 52. The seat member 44 is fixed relative to the support members 50 and pelvis support 48. The thigh supports 54 are at an angle to a horizontal axis B relative to the fasteners 46. The downward angle of the thigh supports 54 is limited by the stop portion 56.

In FIG. 4, the seat 10 is illustrated schematically and has a second operational position in which the back contour 70 of the person in a lumbar flexion is shown in dotted lines. The torso support 39 has rotated forward at the top and back at the bottom around the torso pivot axis defined by the fasteners 40 through an angle from the vertical axis A and the pelvis support 48 has rotated downwardly toward the seat member 44 around the pelvis pivot axis flexing the compliant support 52. The torso support 39 may rotate up to approximately fifty degrees (50°) of rotation of the torso relative to the pelvis from slumped to erect positions. Also, the seat member 44 rotates with the pelvis support 48 about the pelvis pivot axis through an angle from the horizontal axis B while the thigh supports 54 each rotate about an axis parallel to and near to the pelvis pivot axis; the thigh supports 54 are each supported so that they align with the person's thighs independent of the motions of the pelvis support 48 during changes of lumbar curvature, torso recline angle, and distance of the pelvis from the feet. It should be appreciated that the seat 10 may have numerous seating positions for the seated person.

Accordingly, the seat 10 has a pelvis support 48 that pivots about an axis near the bottom of the person's pelvis. The torso support 39 pivots about an axis behind the person's rib cage or torso. The seat 10 may have a compliant support 52 which couples the motion between the pelvis support 48 and torso support 39. The seat 10 moves as the seated person moves, thereby eliminating geometric conflict between the seat 10 and the person's body. Additionally, there is also no relative movement between the seat 10 and the person's body that can cause a shearing action in the skin and underlying tissues.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be described other than as specifically described.

What is claimed is:

1. A seat with biomechanical articulation for a person seated in the seat comprising:

a seat portion extending generally horizontally;

a back portion extending generally upwardly from said seat portion;

a frame interconnecting said seat portion and said back portion;

said seat portion having a seat member pivotally connected to said frame and thigh means pivotally connected to said seat member for supporting thighs of a person seated on said seat member and rotating relative to said seat member in response to movement of said seat member by the person seated in said seat; and pelvis means connected to said seat member for supporting a pelvis of a person seated on said seat member and moving in response to movement of said seat member by the person seated in said seat.

2. A seat as set forth in claim 1 wherein said pelvis means comprises a pelvis support connected to said seat member.

3. A seat as set forth in claim 2 wherein said pelvis means further comprises a support member connected to said seat member and said pelvis support.

4. A seat as set forth in claim 1 wherein said back portion includes a torso support pivotally connected to said frame for supporting a torso of the person seated in said seat.

5. A seat as set forth in claim 1 including compliant support means for urging said pelvis means toward said back portion.

6. A seat as set forth in claim 5 wherein said compliant support means comprises at least one elastic member.

7. A seat as set forth in claim 1 wherein said thigh means comprises at least one thigh support pivotally connected to said seat member.

8. A seat as set forth in claim 7 including a stop portion for supporting said at least one thigh support and limiting downward movement thereof.

9. A seat as set forth in claim 8 wherein said stop portion includes a second support member connected to said frame and a stop member extending from said second support member.

10. A seat as set forth in claim 9 including means for adjusting a height of said stop member relative to said support member.

11. A seat with biomechanical articulation for a person seated in the seat comprising:

a frame including a pair of laterally spaced side members;

a seat portion having a seat member pivotally connected to said frame and extending generally horizontally and at least one thigh support pivotally connected to said seat member for supporting thighs of a person seated on said seat member and rotating relative to said seat member in response to movement of said seat member by the person seated in said seat;

a torso support disposed between said side members and pivotally connected to said side members for supporting a torso of a person seated in said seat; and a pelvis support disposed below said torso support between said side members and support members interconnecting said pelvis support and said seat portion, said pelvis support supporting a pelvis of a person seated in said seat and rotating about an axis relative to said frame in response to movement of the seated person in said seat.

12. A seat as set forth in claim 11 including means for pivotally connecting said torso support to said side members and defining a torso pivot axis.

13. A seat as set forth in claim 11 including at least one compliant member for urging said pelvis support toward said torso support.

14. A seat as set forth in claim 11 wherein said seat portion comprises a seat member connected to said support members.

15. A seat as set forth in claim 11 including a stop portion for supporting said at least one thigh support and limiting downward movement thereof.

16. A seat as set forth in claim 15 wherein said stop portion includes a second support member connected to said frame and a stop member extending from said second support member.

17. A seat as set forth in claim 16 including means for adjusting a height of said stop member relative to said second support member.

18. A seat with biomechanical articulation for a person seated in the seat comprising:

a frame;

a seat member pivotally connected to said frame;

a torso support pivotally connected to said frame and disposed above said seat member for supporting a torso of a person seated in said seat;

a pelvis support disposed below said torso support and support members interconnecting said pelvis support and said seat member, said pelvis support supporting a pelvis of a person seated on said seat member and rotating about an axis relative to said frame in response to movement of the person seated in said seat;

a pair of thigh supports pivotally connected to said seat member for supporting thighs of a person seated on said seat member and rotating relative to said seat member in response to movement of said seat member by the person seated in said seat member to allow independent movement of the thighs relative to each other; and a stop portion for supporting said thigh supports and limiting downward movement thereof.

19. A seat with biomechanical articulation for a person seated in the seat comprising:

a seat portion extending generally horizontally;

a back portion extending generally upwardly from said seat portion;

a torso support connected to said back portion;

a seat frame connected to said back portion and said seat portion;

said seat portion having a seat member pivotally connected to said seat frame and thigh means pivotally connected to said seat member for supporting thighs of a person seated on said seat member and rotating relative to said seat member in response to movement of said seat member by the person seated in said seat; and a pelvis support connected to said seat frame for supporting a pelvis of a person seated on said seat portion and moving in response to movement of said seat portion by the person seated in said seat portion.

* * * * *